United States Patent [19]

Praught et al.

[11] Patent Number: 4,616,205

[45] Date of Patent: Oct. 7, 1986

[54] PREFORMED MULTIPLE TURN TRANSFORMER WINDING

[75] Inventors: Ronald B. Praught, Towaco; Matthew A. Wilkowski, Bayonne, both of N.J.

[73] Assignee: AT&T Bell Laboratories, Murray Hill, N.J.

[21] Appl. No.: 709,894

[22] Filed: Mar. 8, 1985

[51] Int. Cl.[4] ..... H01F 15/02; H01F 27/30

[52] U.S. Cl. ..... 336/82; 336/65; 336/83; 336/195; 336/210; 336/223

[58] Field of Search ..... 336/82, 83, 210, 195, 336/232, 221, 223, 212, 65

[56] References Cited

U.S. PATENT DOCUMENTS

| | | | |
|---|---|---|---|
| 534,802 | 2/1895 | Lemp | 336/195 X |
| 1,986,884 | 1/1935 | Fassler | 336/82 |
| 3,005,965 | 10/1961 | Wertanen | 336/195 X |
| 3,602,859 | 8/1971 | Dao | 336/83 |
| 3,629,759 | 12/1971 | Douglas et al. | 336/82 |
| 3,786,338 | 1/1974 | Gilbert | 336/195 X |
| 4,020,439 | 4/1977 | Thiessens et al. | 336/83 X |
| 4,092,607 | 5/1978 | Robins | 336/195 X |

FOREIGN PATENT DOCUMENTS

| | | | |
|---|---|---|---|
| 292761 | 6/1916 | Fed. Rep. of Germany . | |
| 515865 | 1/1931 | Fed. Rep. of Germany | 336/195 |
| 725978 | 10/1942 | Fed. Rep. of Germany . | |
| 42847 | 4/1970 | Finland | 336/83 |
| 624976 | 6/1949 | United Kingdom | 336/195 |
| 1044526 | 10/1966 | United Kingdom | 336/83 |
| 136791 | 6/1960 | U.S.S.R. . | |
| 1049993 | 10/1983 | U.S.S.R. | 336/195 |

*Primary Examiner*—Thomas J. Kozma
*Attorney, Agent, or Firm*—Alfred G. Steinmetz

[57] ABSTRACT

A transformer includes a preformed winding with each turn having a channel cross section. The individual units are joined to form the desired multiturn winding. Another winding is inserted within the channel cross section of the multiturn winding. In one embodiment, the channels of the two turns are joined to form a closed passageway. In another embodiment, they are nested one within each other to form a concurrent passageway.

12 Claims, 18 Drawing Figures

21
21
21
21
20
5
41
43
49
47
47
43
56
58
30
45
42
49
55
57
46
44
8
48
54
7
48
53
52
51
10
5
6
4
1
3
4
2
4

PREFORMED MULTIPLE TURN TRANSFORMER WINDING

FIELD OF THE INVENTION

This invention relates to transformer construction and more particularly to a construction of the transformer windings.

BACKGROUND OF THE INVENTION

Transformer design is often the art of compromising the conflicting requirements of electrical performance, space requirements and manufacturing and fabrication costs. The electrical performance requirements of the windings often conflict with the difficulties of winding the desired coils with the proper geometry and mechanical integrity at a reasonable cost. At the very least, a transformer winding must have the required number of turns, adequate current handling capacity and the necessary structural strength to withstand electrically induced mechanical stresses. Additional considerations include securing good coupling between the windings and maximizing utilization of the core windows. Many times the practical difficulties inherent in winding the transformer coils such as getting the coil to lay properly, getting proper tension, positioning in and filling the core windows require compromises that limit ultimate electrical performance.

A suitable technique for improving electrical performance while minimizing the aforementioned difficulties has been to use a preformed winding having a channel cross section into which another prewound winding is mechanically inserted. This solves many of the above mentioned constructional difficulties without compromising electrical performance. It also advantageously permits a low profile transformer design suitable for card-type circuit packs. Such an arrangement is disclosed in the pending patent application of F. T. Dickens and W. A. Peterson, entitled "Low Profile Magnetic Structure In Which One Winding Acts As Support For A Second Winding", filed Aug. 13, 1984, Ser. No. 639,859 now U.S. Pat. No. 4,583,068. The arrangement disclosed therein comprises a transformer having a one turn preformed secondary winding and further having the primary enclosed within a channel cross section of the secondary winding. This arrangement, however, is limited to situations where a single turn winding is appropriate since no arrangement exists permitting the preformed winding to have multiple turns.

SUMMARY OF THE INVENTION

A preformed two-turn transformer winding embodying the principles of the invention is designed to be assembled around another winding so that the two windings are coaxial. The two-turn winding is formed of individual turns each having a channel cross section. The individual turns are stacked on top of one another so that in one embodiment the channels form a closed passageway. The two turns are electrically isolated from each other by a film of insulation coating the two channels that electrically isolates adjacent edges except for a series connection employed at the ends of the individual turns to form a two-turn winding. The other transformer winding is inserted into the enclosed passageway. An alternative embodiment of the invention uses two turns having a channel cross section with one cross section smaller than the other so that one turn may be nested within the other. The other transformer winding is located within the open channel cross section of the nested turn.

It is readily apparent that this multiwinding arrangement expands the range of applicability of preformed windings to a larger power range since the overall turns ratio permitted is increased. Furthermore, it permits a center tapped multiwinding where such an arrangement is desired.

This arrangement of a preformed winding also advantageously permits winding arrangements having close coupling and also fully utilizes the window area of the core.

BRIEF DESCRIPTION OF THE DRAWINGS

An understanding of the invention may be readily attained by reference to the following specification and the accompanying drawings in which.

DETAILED DESCRIPTION

Figure 1:
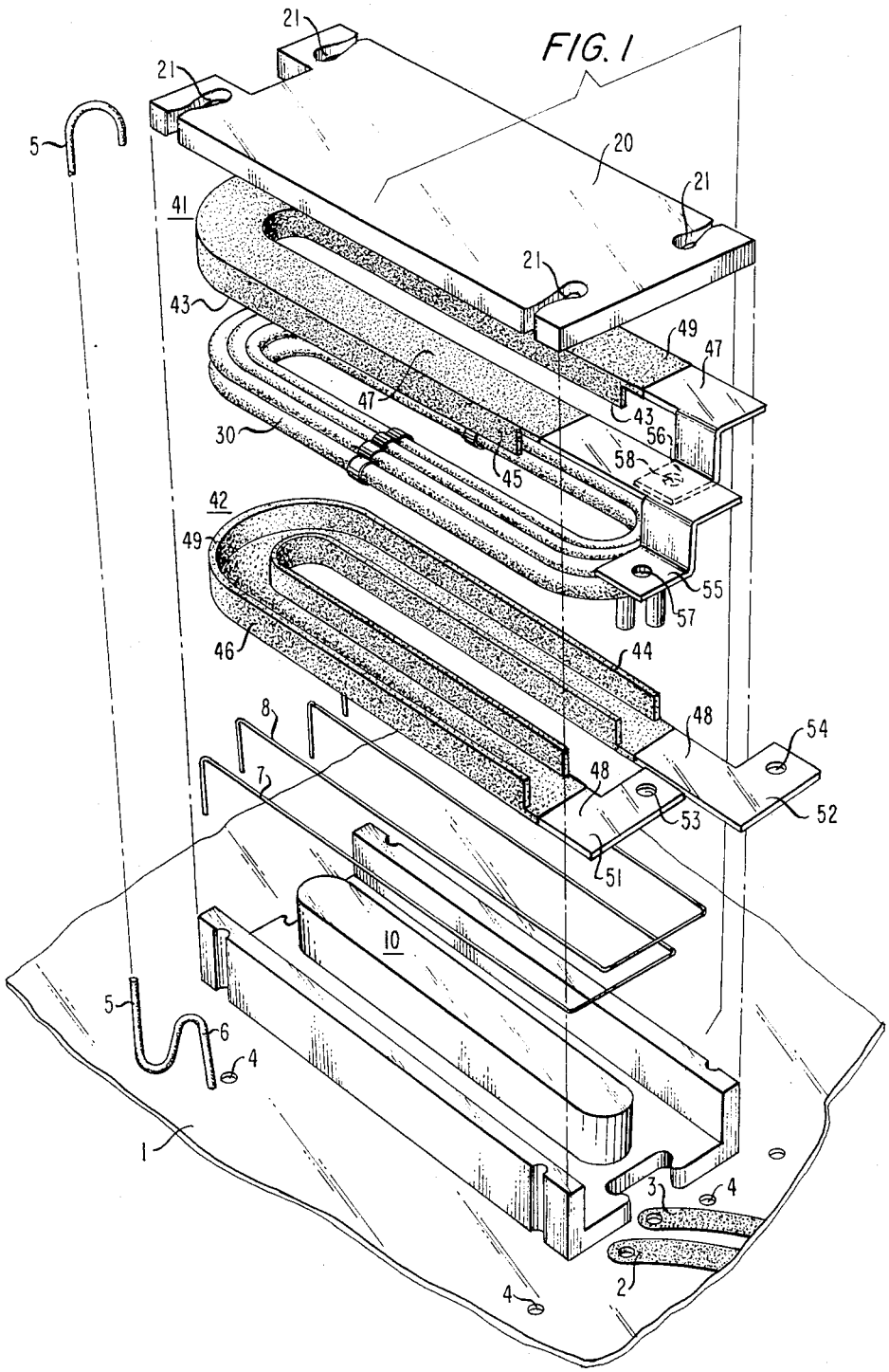
FIG. 1 is a perspective view of a transformer utilizing a multiturn winding embodying the principles of the invention.

The transformer arrangement, shown in FIG. 1, is designed to be board-mounted and to have a very low profile so one circuit board may be mounted in a housing in close proximity with another circuit board. The transformer includes an elongated E shaped magnetic core 10 and a magnetic core cap 20. The cap 20 is secured to the core 10 and the entire assembly to the circuit board 1 by four clips 5 (one is shown) which are each connected into detents 21 in the cap 20 and snap into corresponding detents (not shown) located in the bottom surface of the core 10. The elongated ends 6 of the clip 5 fit into holes or receptacles 7 in the circuit board 1.

The transformer windings include a primary winding 30 formed of a prewound conductor and a secondary winding formed of two U channel cross sectioned conducting turns or units 41 and 42. Conducting units 41 and 42 are each oriented so that the open ends of the channel cross sections face one another. An insulating film or material 49 is applied by dipping the individual conducting units in a liquified insulative material that is then cured into a solid film so that when the edges 43 and 44 are substantially abutted against one another, the two units 41 and 42 remain electrically isolated along these edges. The thickness of the side walls 45 and 46 of the units 41 and 42 and of the bottom wall 47 and 48 may be varied as needed to accommodate an anticipated power range of the transformer. Each conducting unit 41 and 42 with the U channel cross section comprises one complete turn. Units 41 and 42 are stacked on top with the adjacent edges 43 and 44 electrically insulated from each other as described above. They are electrically joined at their ends to form two complete turns.

The ends of the lower conducting unit 42 are extended to form two L shaped shelves 51 and 52 on a plane with the bottom of the channel and with each shelf having a hole 53 and 54 at the end of the L shaped extension. Shelf 51 and hole 53 are used to facilitate an electrical connection with the upper conducting unit 41.

The extensions 55 and 56 of the channel bottom of the upper unit 41 are also L shaped shelves. Each shelf, however, includes a step bend so that the plane of the shelf is positioned substantially coplanar with the bottom shelf extensions 51 and 52. The shelf 56 is directly above the shelf 51 and the holes 58 and 53 are in register with each other. These two shelf extensions may be secured together to electrically join the two conducting units 41 and 42 and create a two-turn winding by a fastening device such as a bolt or by fusing or binding such as welding or soldering. When the two units 41 and 42 are electrically connected, they are positioned to enclose the primary winding 30. The other two free shelves 52 and 55 may be used as the end terminals of the secondary winding and may be secured by fasteners through holes 57 and 54 to conducting paths 2 and 3 on the circuit board or other conductive media. Bias windings 7 and 8 of the transformer are positioned in the bottom of core and may, as shown, comprise loose wire or may comprise a printed circuit winding.

The assembly of the transformer begins with placement of the bias windings 7 and 8 into the core cavity. The primary winding is inserted in the cavity of the lower conducting unit 42, and the upper unit 41 is placed in top of it enclosing the primary winding within the desired passageway formed by the upper and lower units 41 and 42. The two conducting units 41 and 42 are then secured together by suitable fastener hardwire passing through holes 53 and 58. The assembled winding is then dropped into place in core 10, and then core 10 and cap 20 are secured together by the clips 5, which facilitate mounting the unit on a circuit board 1.

Figure 2:
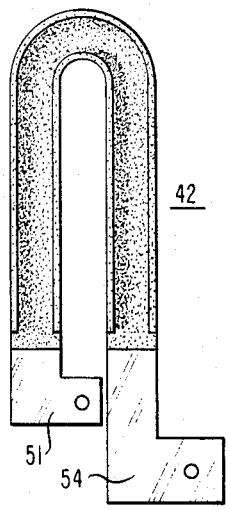
FIGS. 2, 3 and 4 are orthogonal projections of a component of the multiturn winding shown in FIG. 1.
Figure 3:
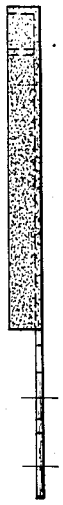
Figure 4:
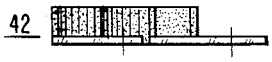
Figure 5:
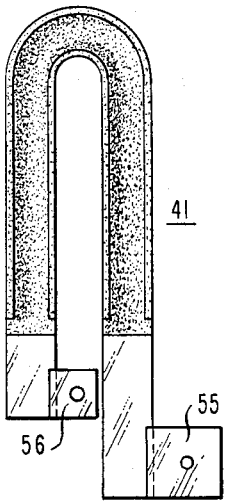
FIGS. 5, 6 and 7 are orthogonal projections of another component of the multiturn winding shown in FIG. 1.
Figure 6:
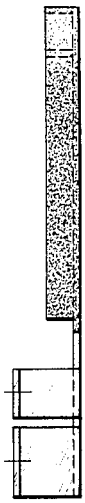
Figure 7:
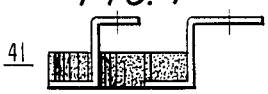

The details of the lower conducting unit 42 and upper conducting unit 41 are shown in the orthogonal projections in FIGS. 2, 3, 4, 5, 6 and 7, respectively. The bottom unit 42 has a channel cross section as shown in FIG. 4 and the base of the channel has two L shaped shelf extensions 51 and 54 as shown in FIG. 2. The shelf extensions are offset in length so that one 54 may serve as a winding terminal and the other 51 a midwinding connection of the two-turn winding. The upper unit 41 has a channel cross section as shown in FIG. 7 and two L shaped shelf extensions 55 and 56 as shown in FIG. 5. Each shelf extension has a step which is apparent in the views shown in FIGS. 6 and 7 so that the shelf of the top unit is nearly coplanar with a mating surface of a shelf extension of the bottom unit 42.

Figure 8:
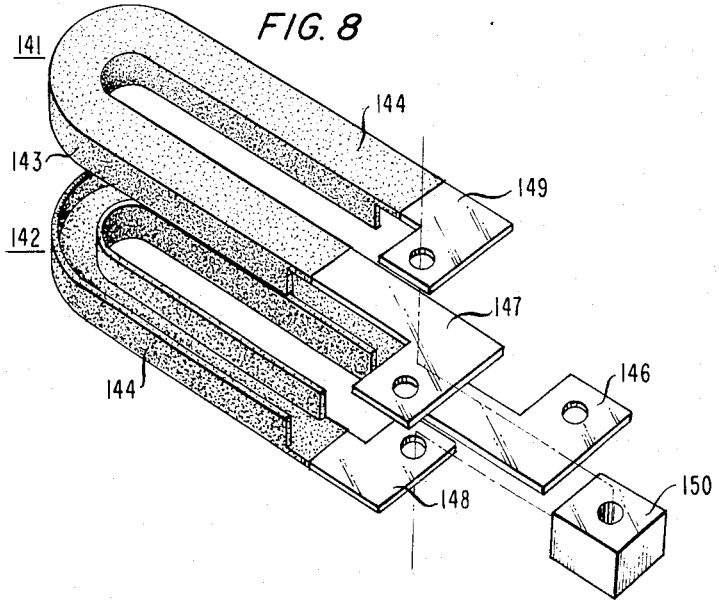
FIG. 8 is a perspective view of another configuration of a multiturn winding embodying the principles of the invention.

A variation of a secondary winding arrangement embodying the principles of the invention unit is disclosed in FIG. 8 comprising two identical conducting units 141 and 142. The two units are joined together along their edges, with a primary winding positioned within the resulting enclosed passageway. An insulating film 144 coating the units electrically isolates the two windings from each other at the adjacent edges. The two windings 141 and 142 are electrically connected in series by a conductive spacer 150 conductively joining the L shaped shelf extensions 148 and 149 respectively to create a two-turn winding. The outer L shelves 146 and 147 are used to provide the start and finish termination leads of the completed secondary winding.

Figure 9:
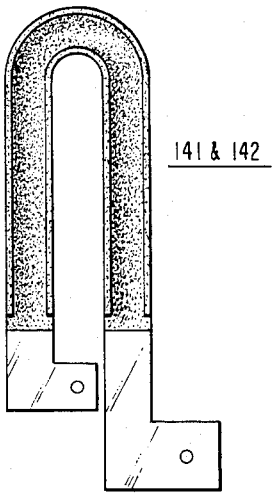
FIGS. 9, 10 and 11 are orthogonal projections of a component of the multiturn winding shown in FIG. 8.
Figure 10:
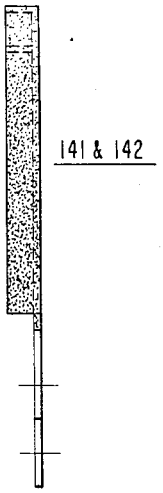
Figure 11:
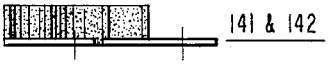
Figure 13:
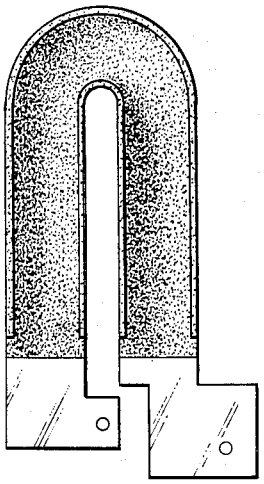
FIGS. 13, 14 and 15 are orthogonal projections of a component of the multiturn winding shown in FIG. 12, and FIGS. 16, 17 and 18 are orthogonal projections of another component of the multiturn winding shown in FIG. 12.
Figure 14:
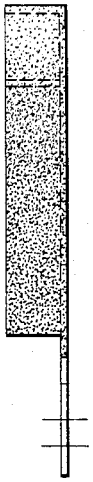
Figure 15:
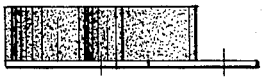
Figure 18:
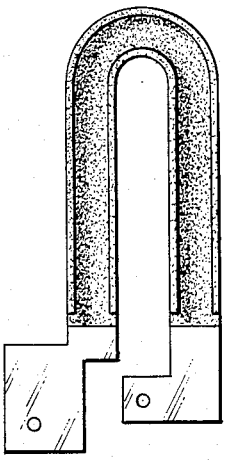
Figure 17:
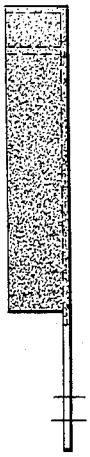
Figure 18:
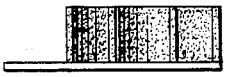

As is apparent from the detailed drawing of FIGS. 9 through 11, the two individual units 141 and 142 are identical in geometry and are of the same handedness. They mate together, as shown in FIG. 8, form a two-turn winding with an enclosed passageway.

Figure 12:
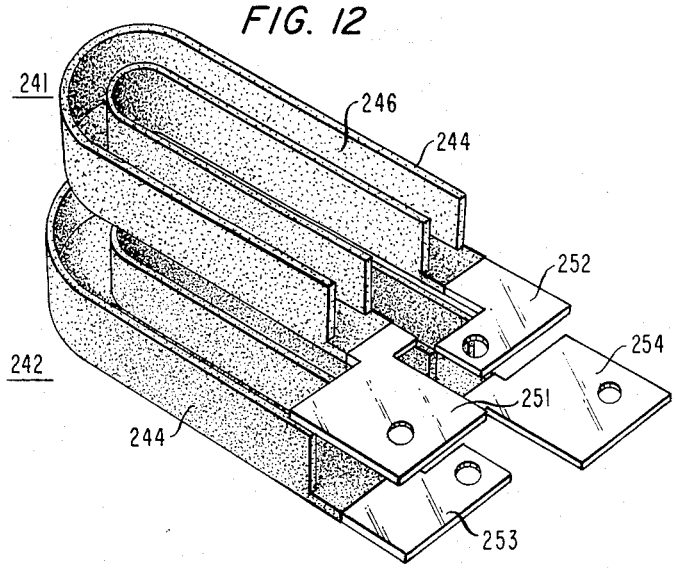
FIG. 12 is an exploded perspective view of another multiturn transformer winding embodying the principles of the invention.

A third winding arrangement is disclosed in a perspective view in FIG. 12 in which the two winding units 241 and 242 are sized differently so that the upper conducting unit 241 may be nested into or fit within the channel cross section of the bottom conducting unit 242 with the opening of the channels facing in the same direction for both conducting units. The conductive cross sectional area of both conducting units is selected so that both units have the same conductive cross sectional area. Hence, a thinner conductive material is used for the lower shell winding. This matching of conductive area allows for equalization of dissipative losses in each individual conducting unit. The two turns are insulated from each other by a layer of insulation (possibly epoxy) on the surfaces of the two units.

Each turn has the base of its channel extended into L shaped shelves 251–254. The shelf extensions 251–252 of the top unit 241 are oriented in a direction opposite to the extension direction of shelves 253 and 254 of the bottom unit 242. Holes are in shelves 252 and 253 permit attachment of the conducting units to each other to form two series connected turns. Holes in shelves 251 and 254 are used for terminating the two turns.

The prewound primary winding is inserted in the open channel 246 of the upper turn 241 which is left uncovered. The arrangement has very low leakage inductances between the two turns and is imminently suitable for application when the individual turns of the secondary conduct alternately when the winding is center tapped and current is switched between the two turns.

The two winding units 241 and 242 differ in handedness as shown in FIGS. 13, 14, 15, 16, 17 and 18, respectively. This permits the shelf extensions 251 and 254 to clear each other and be used as winding termination connections.

It is readily apparent that by successive nesting arrangements the arrangement of FIG. 12 may be extended beyond two turns to multiple turns. Such arrangements are believed to be readily apparent to those skilled in the art.

What is claimed is:

1. A transformer comprising:

a core having first and second windows around a central core leg, a first conductor unit threaded through the first and second windows to encircle the central core leg and having a channel shaped cross section, a second conductor unit threaded through the first and second windows to encircle the central core leg and having a channel shaped cross section, the first and second conductor units positioned adjacent to one another with an open edge of the channel cross section of each of the first and second conductor units being substantially adjacent to one another and including means for electrically insulating the first and second conductor units from each other, a conducting mechanism electrically connecting the first and second conductors in a series connection, a third conductor encircling the central core leg leg and included within the channel cross section of each of the first and second conductor units.

2. A transformer as defined in claim 1 wherein the first and second conductor units are positioned so that the first conductor unit is nested within the second conductor unit.

3. A transformer as defined in claim 1 wherein the first and second conductor units are positioned so that channel cross sections are joined to form a closed passageway.

4. A transformer as defined in claims 2 or 3 wherein each conductor unit includes two shelf extensions extending beyond a channel cross section of the unit an one shelf at each unit operative to connect the units in series to form a two-turn winding.

5. A transformer comprising:

a core having first and second windows around a central core leg, a first winding comprising a multiwound conductor threaded through the first and second windows and encircling the central core leg, a second winding comprising:

a first conductor threaded through the first and second windows to encircle the central core leg and having a channel shaped cross section, a second conductor threaded through the first and second windows to encircle the central core leg and having a channel shaped cross section, the first winding positioned within the channel cross section of the first conductor, the second conductor positioned so that the first winding is positioned within the channel cross section of the second conductor, a conducting mechanism electrically connecting the first and second conductors in a series connection to form a continuous multiturn second winding.

6. A transformer as defined in claim 5 wherein the first and second conductors are substantially adjacent to one another with the conductors positioned to form a closed passageway from the two channel cross sections, and the first winding being fully enclosed within the passageway.

7. A transformer as defined in claim 5 wherein the first and second conductors are dimensioned so that a channel cross section dimension of the first conductor is less than a channel cross section dimension of the second conductor and the first conductor is nested within the second conductor and the first winding is positioned within the channel cross section of the first conductor.

8. A transformer as defined in claim 7 wherein the first and second conductors have equal cross section areas of conducting material.

9. A transformer comprising:

a magnetic core including a central core leg separating two windows, first and second windings wound through the two windows so as to encircle the central core leg, the first winding including:

a first conducting element having a longitudinal cavity along its length, and a second conducting element having a longitudinal cavity along its length, the first and second conducting elements positioned with the longitudinal cavity of each adjacent to each other, means for electrically insulating the first and second conducting elements from each other, means for electrically connecting the first and second conducting elements in series connection with each other, and the second winding being located within the longitudinal cavity of the first and second conducting elements.

10. A transformer as defined in claim 9 wherein the first and second conducting elements are mechanically joined with the longitudinal cavities of each forming a closed passageway which contains the second winding.

11. A transformer as defined in claim 9 wherein the first conducting element is nested within the longitudinal cavity of the second conducting element and the elongated cavity of the first conducting element contains the second winding.

12. A transformer as defined in claims 10 or 11 wherein the longitudinal cavity has a channel shaped cross section.

* * * * *